US012421806B2

(12) United States Patent
Burky et al.

(10) Patent No.: US 12,421,806 B2
(45) Date of Patent: Sep. 23, 2025

(54) SMART CABLE RELEASE TOOL

(71) Applicant: Halliburton Energy Services, Inc., Houston, TX (US)

(72) Inventors: Thomas Burky, Alvarado, TX (US); Gerald Graves Craddock, Jr., Alvarado, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/441,836

(22) Filed: Feb. 14, 2024

(65) Prior Publication Data

US 2025/0257614 A1 Aug. 14, 2025

(51) Int. Cl.
*E21B 17/02* (2006.01)
*E21B 23/00* (2006.01)
*E21B 47/12* (2012.01)

(52) U.S. Cl.
CPC ..... *E21B 17/023* (2013.01); *E21B 23/00* (2013.01); *E21B 47/12* (2013.01)

(58) Field of Classification Search
CPC ..... E21B 17/023; E21B 23/00; E21B 47/12
See application file for complete search history.

(56) References Cited

U.S. PATENT DOCUMENTS 2,589,599 A * 3/1952 Bond ..... E21B 31/00 73/862.541
6,032,733 A * 3/2000 Ludwig ..... E21B 17/06 166/385
7,114,563 B2 10/2006 Rose
7,967,072 B2 * 6/2011 McKee ..... E21B 17/023 166/385
9,657,540 B2 5/2017 Coles et al.
10,590,746 B2 3/2020 Burky et al.
10,597,972 B2 3/2020 Burky et al.
11,753,889 B1 9/2023 Eitschberger et al.
2004/0134667 A1 * 7/2004 Brewer ..... E21B 17/023 166/242.6
2013/0168078 A1 * 7/2013 McCarter ..... E21B 43/1193 166/242.6
2015/0027736 A1 1/2015 Smaardyk et al.
2015/0330172 A1 * 11/2015 Allmaras ..... E21B 23/14 166/250.01
2017/0226814 A1 * 8/2017 Clemens ..... E21B 23/00
2023/0175388 A1 6/2023 Song et al.

OTHER PUBLICATIONS

International Search Report and Written Opinion for International Patent Application No. PCT/US2024/017856 dated Oct. 31, 2024. PDF file. 8 pages.
Core Laboratories, Addressable Cablehead Tension Tool, Available at https://www.corelab.com/products/addressable-cablehead-tension-tool/, Accessed Feb. 13, 2024.
Halliburton, Fishing Avoidance, Releasable Wireline Cable Head (RWCH Tool), Oct. 2017.

* cited by examiner

*Primary Examiner* — Matthew R Buck
(74) *Attorney, Agent, or Firm* — John W. Wustenberg; C. Tumey Law Group, PLLC

(57) ABSTRACT

A system that includes an automatic cable head that includes a strain gauge configured to measure a tension associated with a cable attached to the automatic cable head, and a release mechanism configured to connect to a tool, and a controller, configured to receive load data from the strain gauge, and control the release mechanism based on the tension measured by the strain gauge.

20 Claims, 9 Drawing Sheets

SMART CABLE RELEASE TOOL

BACKGROUND

The oil and gas industry may use wellbores as fluid conduits to access subterranean deposits of various fluids and minerals which may include hydrocarbons. A drilling operation may be utilized to construct the fluid conduits which are capable of producing hydrocarbons disposed in subterranean formations. Wellbores may be constructed, in increments, as tapered sections, which sequentially extend into a subterranean formation.

BRIEF DESCRIPTION OF DRAWINGS

These drawings illustrate certain aspects of some examples of the present disclosure and should not be used to limit or define the disclosure.

DETAILED DESCRIPTION

Overview and Advantages

Figure 1:
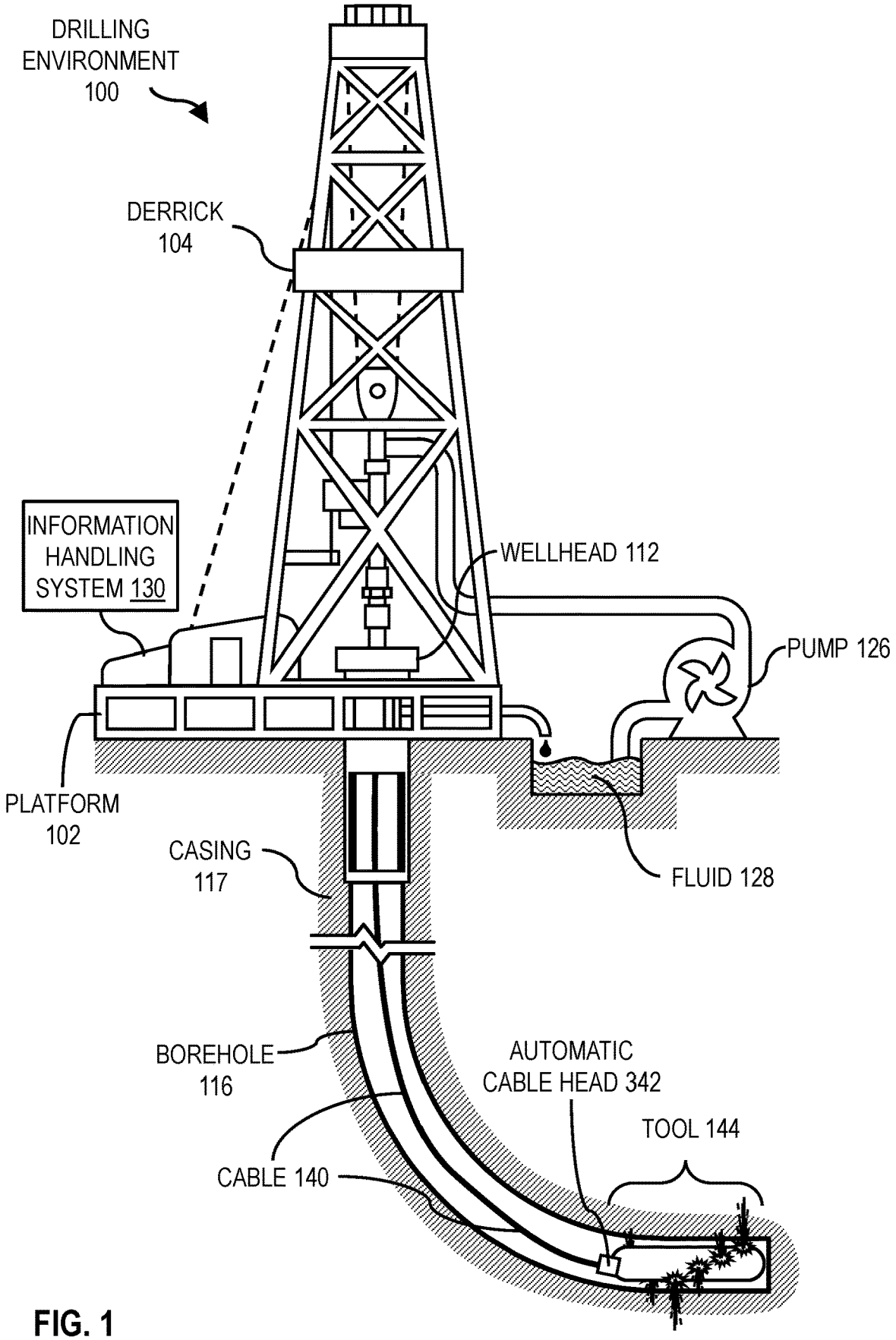
FIG. 1 is a diagram of an example drilling environment.

In general, this application discloses one or more embodiments of methods and systems for a cable release tool that reliably and repeatably disconnects a cable when exceeding a preset load threshold load on the cable. Specifically, as disclosed in one or more embodiments herein, an automatic cable head is described that includes (i) a means for measuring the tension on a cable, and (ii) a means for automatically disconnecting the cable from the tool when a measured tension is exceeded.

In conventional systems, a tool (e.g., perforating gun, plug, gauge, valve, etc.) may be attached to a cable (e.g., slickline or a multistranded/braided steel cable wireline) via a "cable head" connection, where the cable head and tool may each have larger diameters, respectively, than the cable. The tool may then be lowered (via the cable) into a borehole by pumping a liquid into the borehole (with the tool) to carry the tool to a desired location (i.e., a "pump down" operation). Accordingly, during the pump down operation, large forces may be applied to the larger-diameter upstream-facing surfaces and sides of the cable head and tool, causing tension on the cable.

In some instances, the tension applied to the cable may exceed the maximum tensile load of the cable (e.g., when the flow rate of the pump is too great, or shocks are applied to the cable, etc.). When the tension applied to the cable exceeds the maximum tensile load, the cable may partially fail (e.g., undergo strand separation, "bird's nest", ductile elongation, etc.) and/or fail causing the cable to separate into two or more detached sections (e.g., shear, break, etc.).

When a cable fails, the cable separates at (or near) the weakest point along the cable. As the cable may be over two miles in length, the location of the weakest portion of the cable is likely unknown (and therefore the location of the failure is, similarly, unknown). Such unknowns are undesirable. Thus, in order to prevent the cable from breaking at an unknown location, a weak point is intentionally introduced into the cable and tool connection, thereby providing a more likely location for separation to occur.

As an example, a braided cable with twelve strands may have a maximum tensile load of 12,000 lbs (1,000 lbs per strand) and a rated working load up to 8,000 lbs (667 lbs per strand). When using such a cable in conventional systems, it may be desirable not to exceed the working load (8,000 lbs) of the braided cable to avoid partial or total failure at an unknown location. Accordingly, the connection between the cable and the cable head may be constructed such that the connection fails when exceeding the working load (8,000 lbs) thereby preventing the cable from experiencing any load significantly greater than 8,000 lbs.

Using the described example cable, to ensure the cable disconnects at (approximately) the working load (8,000 lbs), only eight of the twelve strands are connected to the cable head. Thus, when the cable is placed under the maximum working load (8,000 lbs), the eight connected strands experience the same 8,000 lbs (combined)—causing each of those eight strands to individually experience 1,000 lbs (the max tensile load of each strand).

Accordingly, shortly after reaching the working load (8,000 lbs) and/or if the load continues to increase beyond the working load, one of the eight connected strands is likely to fail at the cable head. Once the first strand breaks, the load on the remaining strands remains constant (8,000 lbs) but now supported by only seven strands (~1,143 lbs per strand). Consequently, one of those seven strands is likely to fail, further increasing the load on each of the remaining six strands—similarly causing the remainder of the strands to break until the entire cable fails (at or near the cable head).

However, such a conventional system has several drawbacks. Initially, the desired failure location (the connection between the cable and the cable head) is not certain to be the actual failure location. Rather, the actual failure location is based on a "statistical" likelihood, which merely tends towards the desired failure location. Consequently, using the conventional technique does not provide reliable, repeatable, or consistent results. Further, even when the cable fails where designed, the cable is damaged. That is, when strands of the cable experience rapid failure, other portions of the cable may experience stretching, buckling, and twisting—forcing maintenance and inspection of the lower distal end of the cable. Lastly, in conventional systems, the only feedback from the tool is the load measured at the surface of the borehole. However, the load measured at the surface may be inaccurate and/or lag the actual load on the cable. Accordingly, the cable may fail because those surface measurements are inaccurate (i.e., providing inaccurately low readings) and/or the data was received and analyzed too slowly (i.e., not allowing sufficient time to decrease force prior to failure).

As disclosed in one or more embodiments herein, a smart cable release tool is provided that autonomously releases the cable head from the tool when exceeding a preset load threshold. Specifically, in one or more embodiments disclosed herein, a conventional cable head is replaced with an automatic cable head that may include a strain gauge, a controller, and a release mechanism. In combination, those components allow for the measurement of tensile load on the cable, comparison of the load to a preset load threshold, and release of the tool depending on the measured load. Consequently, the cable may be attached to the cable head to allow for greater forces (i.e., attaching all strands, and not intentionally adding a weak point) and therefore greater loads may be placed on the cable when placing a tool. Further, as the automatic cable head is downhole with the tool, there is reduced delay between the actual load, measurement, analysis, and release of the tool (compared to sending and analyzing the load data uphole, at the surface).

FIG. 1

FIG. 1 is a diagram of an example drilling environment. Drilling environment 100 may include platform 102 that supports derrick 104. As shown, drilling environment 100 is used for lower cable 140 and tool 144 into borehole 116. Each of these components is described below.

Platform 102 is a structure which may be used to support one or more other components of drilling environment 100 (e.g., derrick 104). Platform 102 may be designed and constructed from suitable materials (e.g., concrete) which are able to withstand the forces applied by other components (e.g., the weight and counterforces experienced by derrick 104). In any embodiment, platform 102 may be constructed to provide a uniform surface for drilling operations in drilling environment 100.

Derrick 104 is a structure which may support, contain, and/or otherwise facilitate the operation of one or more pieces of equipment (e.g., tool 144). In any embodiment, derrick 104 may provide support for a crown block, traveling block, and/or any part connected to (and including) cable 140. Derrick 104 may be constructed from any suitable materials (e.g., steel) to provide the strength necessary to support those components.

Wellhead 112 is a machine which may include one or more pipes, caps, and/or valves to provide pressure control for contents within borehole 116 (e.g., when fluidly connected to a well (not shown), when pumping fluid 128). In any embodiment, during drilling, wellhead 112 may be equipped with a blowout preventer (not shown) to prevent the flow of higher-pressure fluids (in borehole 116) from escaping to the surface in an uncontrolled manner. Wellhead 112 may be equipped with other ports and/or sensors to monitor pressures within borehole 116 and/or otherwise facilitate drilling operations.

Borehole 116 is a hole in the ground which may be formed by a drillstring (and one or more components thereof). Borehole 116 may be partially or fully lined with casing 117 to protect the surrounding ground from the contents of borehole 116, and conversely, to protect borehole 116 from the surrounding ground.

Casing 117 is concrete and/or metal lining that separates borehole 116 from the surrounding ground. Casing 117 may be used to protect the surrounding ground from the contents of borehole 116, and conversely, to protect borehole 116 from the surrounding ground.

Cable 140 is one or more strands of material used to provide tensile strength. In one or more embodiments, when cable 140 is constructed from two or more strands, the strands may be twisted and/or braided to form a rope. Strands may be constructed from any suitable material (e.g., iron, steel, any metal alloy, etc.). In any embodiment, cable 140 may be coated (e.g., with plastic) to protect the cable material from corrosion and/or rust. In any embodiment, distal ends of cable 140 may be terminated with Flemish eyes, turnback eyes, swages, clips, and/or any other mechanism to allow for the attachment of another device (e.g., automatic cable head 342).

Automatic cable head 342 is an electromechanical device that connects cable 140 to tool 144. Additional details regarding automatic cable head 342 may be found in the description of FIGS. 3A-3D.

Tool 144 is any machine for creating borehole 116, modifying borehole 116, maintaining borehole 116, measuring the surrounding environment. In any embodiment, tool 144 may be disposed at (or near) the end of cable 140 and pumped down to a desired location in borehole 116. Non-limiting examples of tools include a perforating gun, plug, gauge, valve, a mud motor, actuators (and pistons attached thereto), a steering system, and any measurement tool (e.g., sensors, probes, particle generators, etc.).

In one or more embodiments, measurements from tool 144 and/or automatic cable head 342 may be transmitted to the surface (e.g., to information handling system 130). Non-limiting examples of techniques for transferring tool measurement data (to the surface) include mud pulse telemetry and through-wall acoustic signaling. For through-wall acoustic signaling, one or more repeater(s) may detect, amplify, and re-transmit signals from the sending device (e.g., automatic cable head 342) to the surface (e.g., to information handling system 130), and conversely, from the surface (e.g., from information handling system 130) to the device downhole.

Pump 126 is a machine that may be used to circulate fluid 128 from a reservoir, through a feed pipe, to derrick 104, to the interior of borehole 116, back upward through borehole 116, and back into the reservoir. In any embodiment, any appropriate pump 126 may be used (e.g., centrifugal, gear, etc.) which is powered by any suitable means (e.g., electricity, combustible fuel, etc.).

Fluid 128 is a liquid which may be pumped through drillstring and borehole 116 to collect drill cuttings, debris, and/or other matter from borehole 116. Further, fluid 128 may provide a means for placing tool 144 at a desired location in borehole 116 when gravity may not be sufficient to place tool 144 (e.g., in horizontal sections of borehole 116). In any embodiment, fluid 128 may be circulated via pump 126 and optionally filtered to remove unwanted debris.

Information handling system 130 is a hardware computing system which may be operatively connected to drillstring (and/or other various components of the drilling environment). In any embodiment, information handling system 130 may utilize any suitable form of wired and/or wireless communication to send and/or receive data to and/or from other components of drilling environment 100. In any embodiment, information handling system 130 may receive a digital telemetry signal, demodulate the signal, display data (e.g., via a visual output device), and/or store the data. In any embodiment, information handling system 130 may send a signal (with data) to one or more components of drilling environment 100 (e.g., to control one or more tools on automatic cable head 342 and/or tool 144). In any embodiment, information handling system 130 may be utilized to perform various steps, methods, and techniques disclosed herein (e.g., via the execution of software). In any embodiment, information handling system 130 may include one or more processor(s), cache, memory, storage, and/or one or more peripheral device(s). Any two or more of these components may be operatively connected via a system bus that provides a means for transferring data between those components.

FIGS. 2A-2B

Figure 2A:
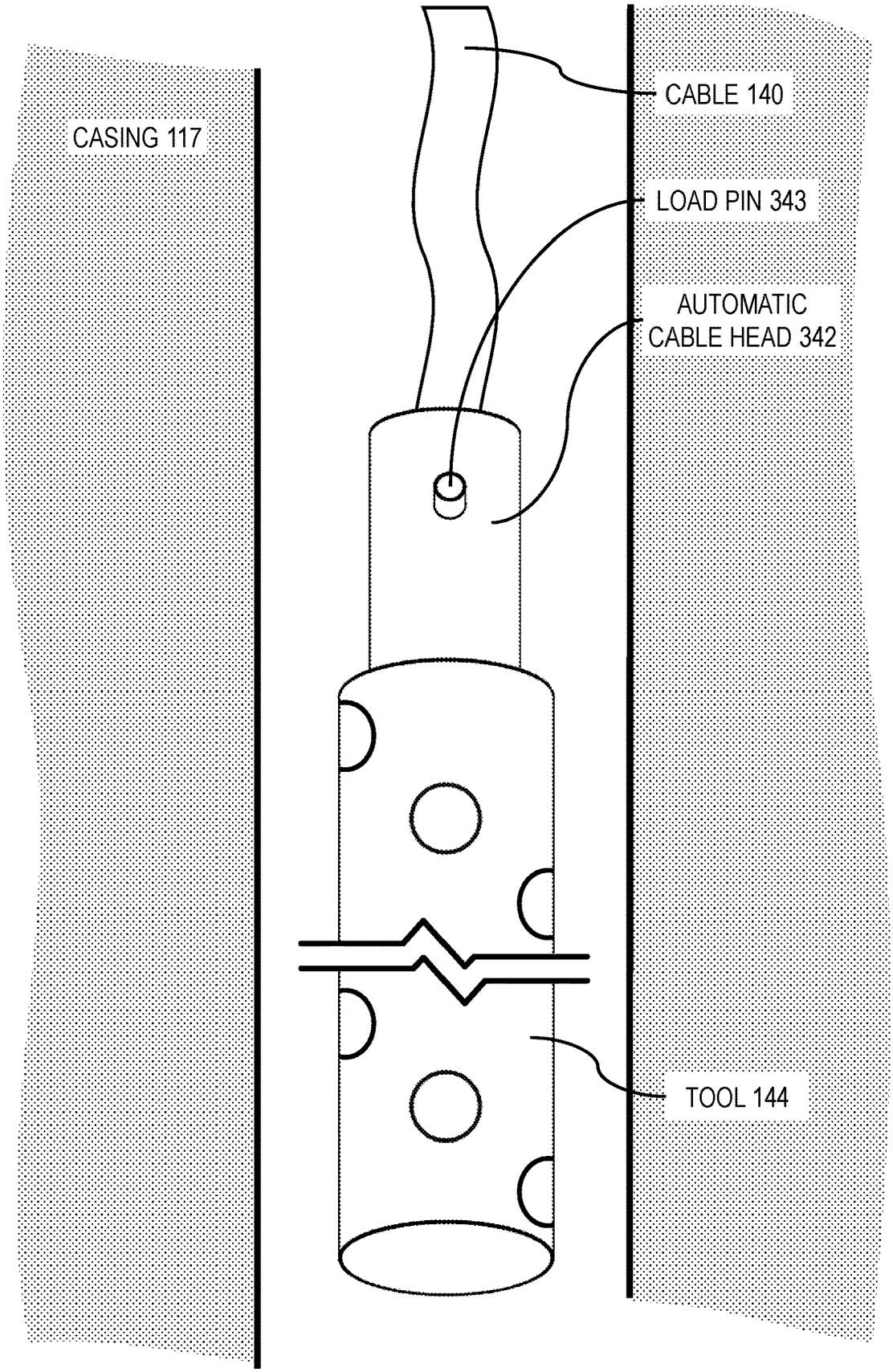
FIG. 2A is a diagram of a tool attached to a cable via an automatic cable head.
Figure 2B:
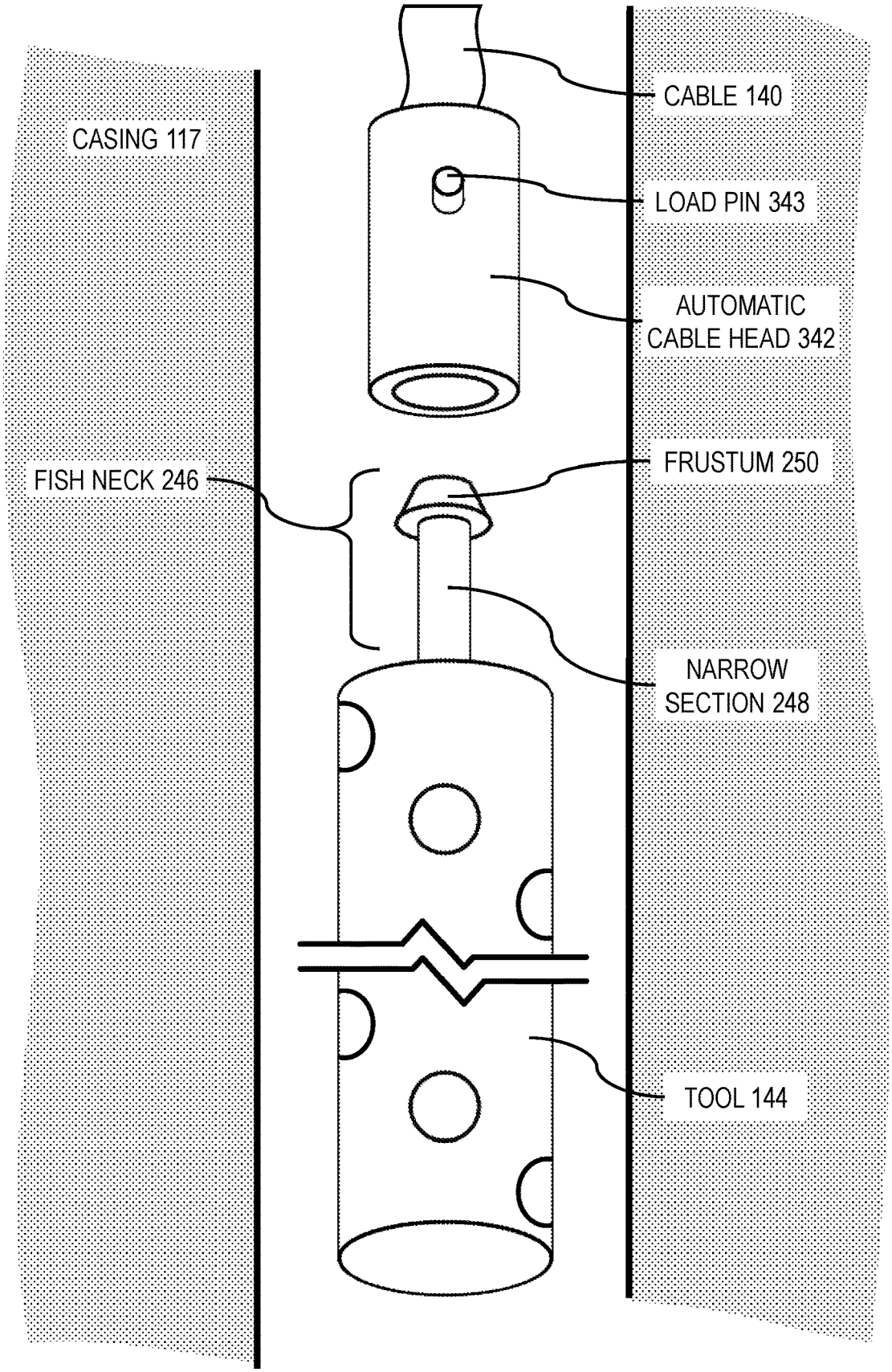
FIG. 2B is a diagram of a tool after detaching from a cable via an automatic cable head.

FIG. 2A is a diagram of a tool attached to a cable via an automatic cable head. FIG. 2B is a diagram of a tool after detaching from a cable via an automatic cable head.

Automatic cable head 342 is an electromechanical device that connects cable 140 to tool 144. Additional details regarding automatic cable head 342 may be found in the description of FIGS. 3A-3D.

Load pin 343 is an optional structural member of automatic cable head 342. Additional details regarding load pin 343 may be found in the description of FIGS. 3A-3D.

Fish neck 246 is a structural member of tool 144 (or attached to tool 144). In one or more embodiments, fish neck 246 includes narrow section 248 and frustum 250. Fish neck 246 may be used to releasably affixed tool 144 to automatic cable head 342. In one or more embodiments, fish neck 246 may additionally be utilized for retrieving a detached tool 144 after separation from automatic cable head 342 (e.g., using a mechanism for retrieving detached tools).

Narrow section 248 is a structural member of fish neck 246 that protrudes from tool 144 in an uphole direction. In one or more embodiments, narrow section 248 has a narrower diameter than frustum 250. Narrow section 248 may have any suitable cross-sectional shape (e.g., circle, square, rectangle, pentagon, etc.). Non-limiting examples of narrow section 248 include a rod, bar, pipe, and/or any suitable elongated member.

Frustum 250 is a structural portion of fish neck 246 that includes a wider outer diameter than narrow section 248. In any embodiment, frustum 250 may be affixed to an uphole distal end of narrow section 248 to form fish neck 246. In one or more embodiments, frustum 250 may have a geometry that allows for being releasably affixing automatic cable head 342 (and/or release mechanism 360 and claw 364 thereof). Frustum 250 may have any suitable cross-sectional shape (e.g., circle, square, rectangle, pentagon, etc.).

FIGS. 3A-3C

Figure 3A:
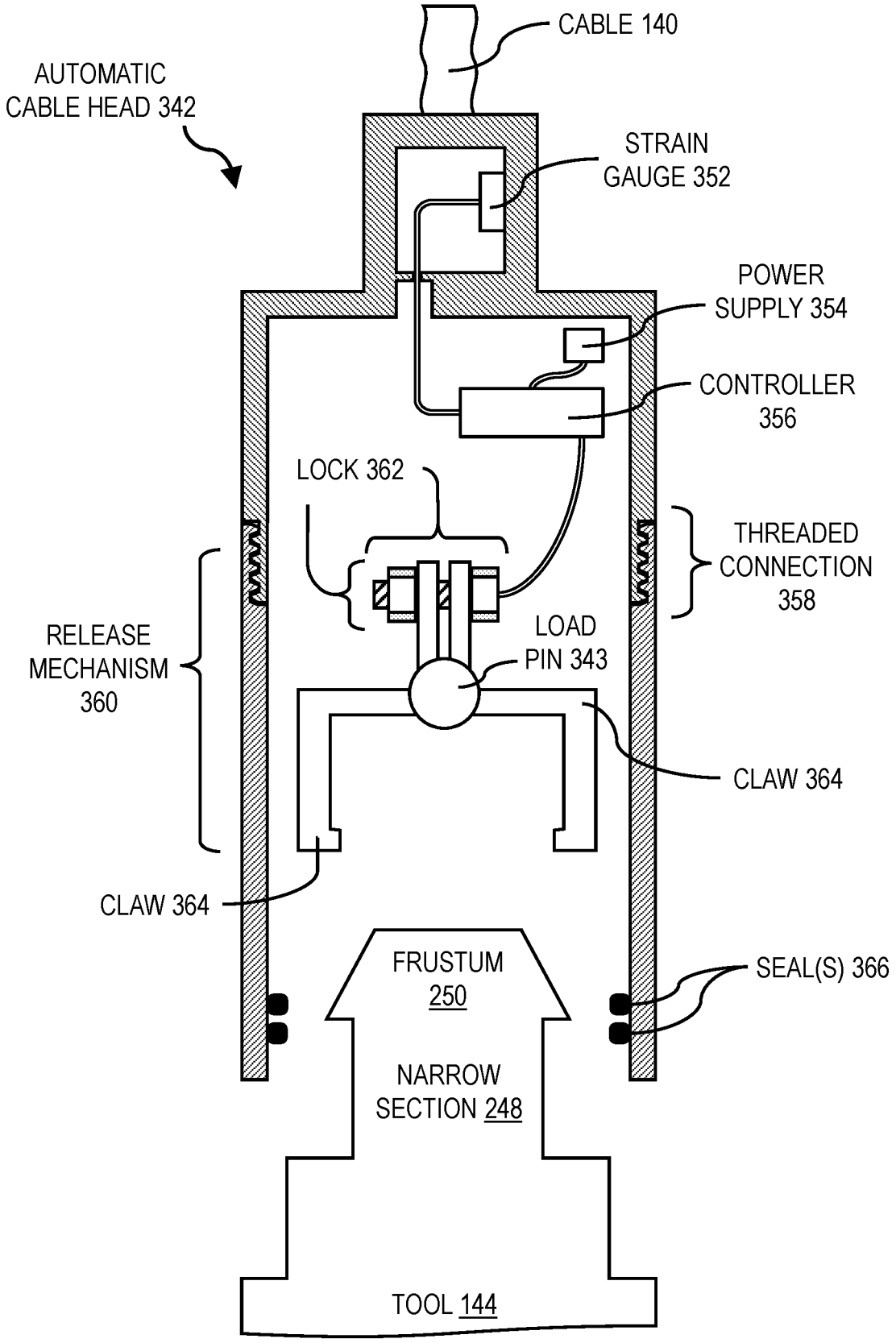
FIG. 3A is a diagram of an automatic cable head prior to attachment to a tool.
Figure 3B:
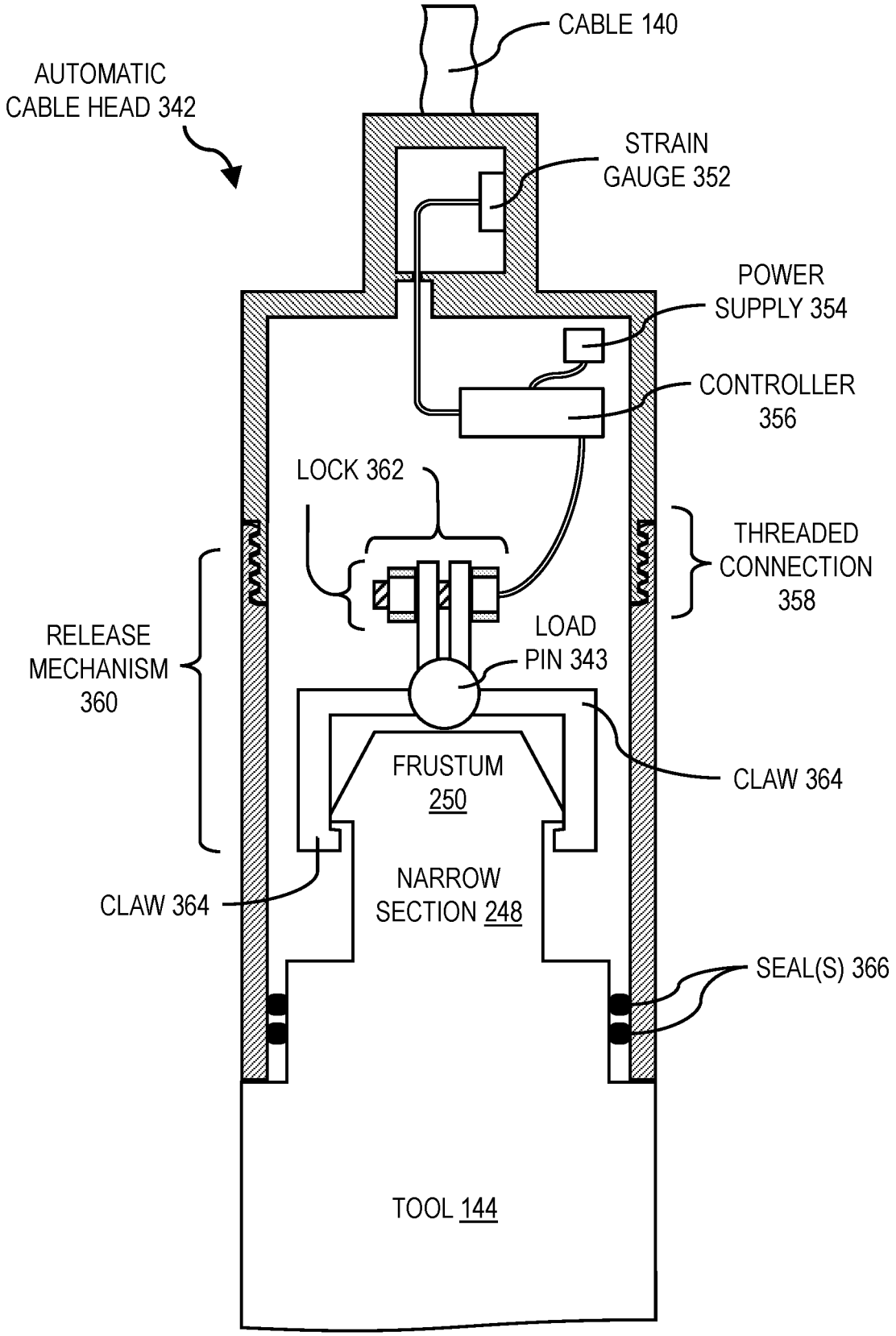
FIG. 3B is a diagram of an automatic cable head attached to a tool.
Figure 3C:
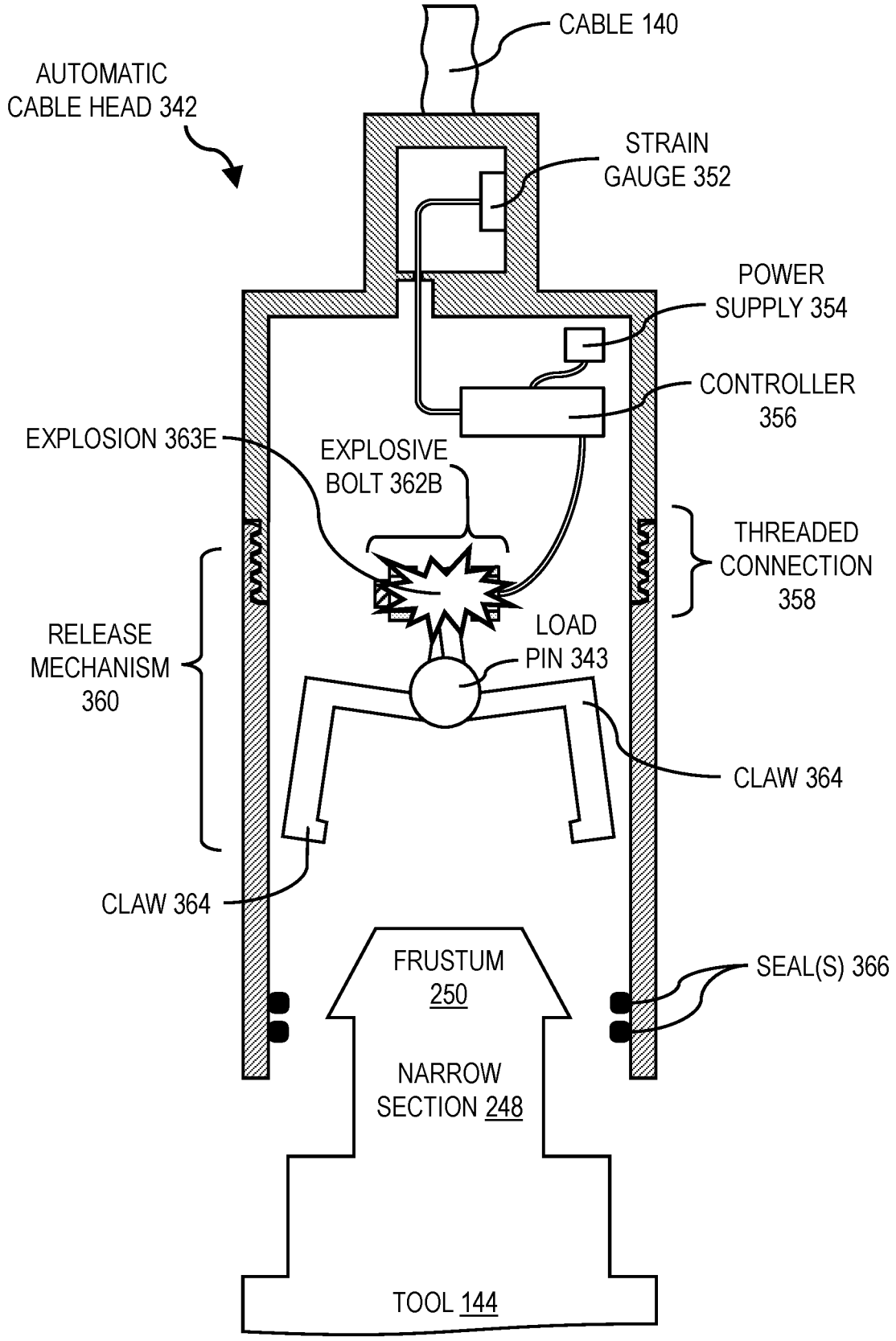
FIG. 3C is a diagram of an automatic cable head after detaching from a tool using an explosive bolt.
Figure 3D:
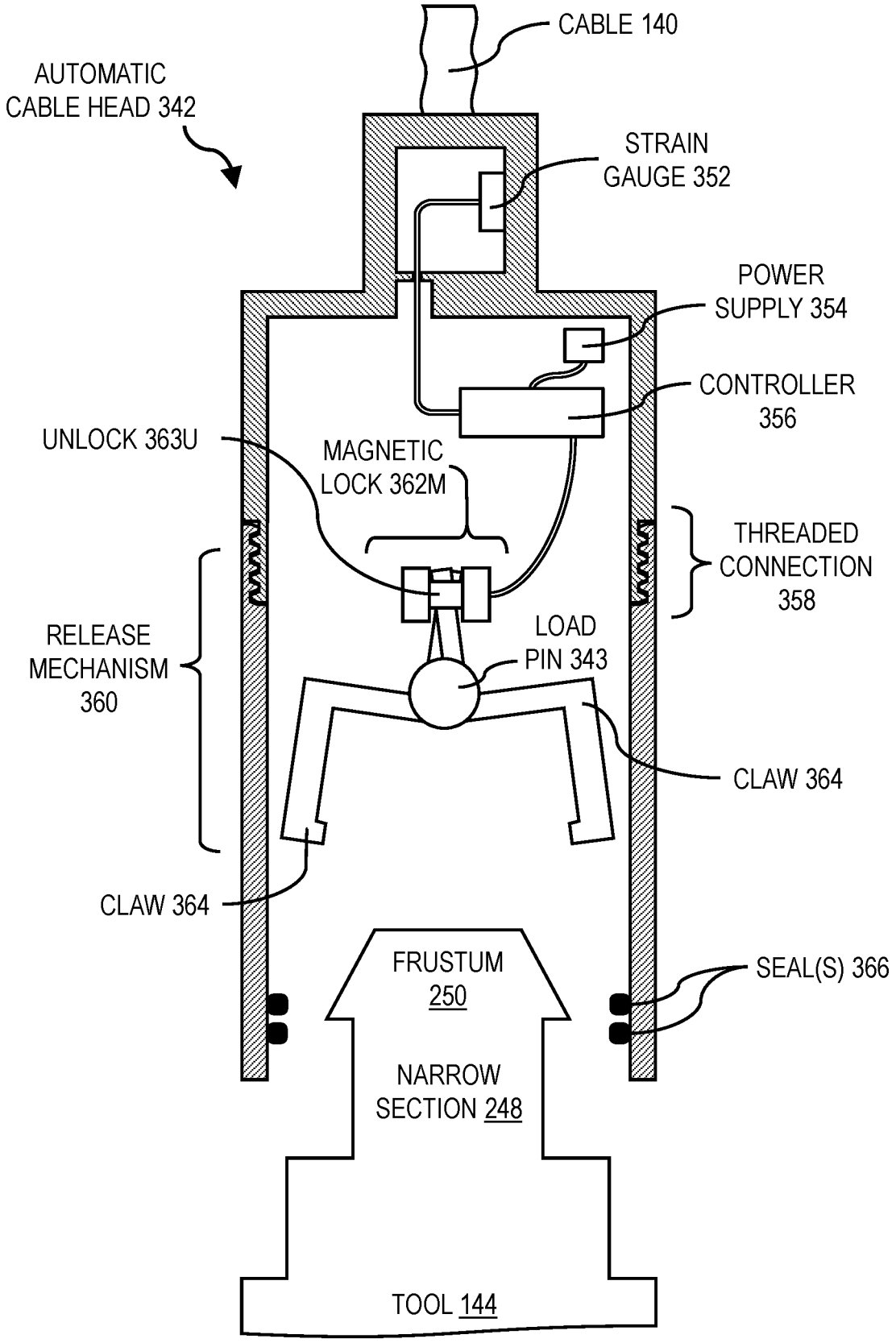
FIG. 3D is a diagram of an automatic cable head after detaching from a tool using a magnetic lock.

FIG. 3A is a diagram of an automatic cable head prior to attachment to a tool. FIG. 3B is a diagram of an automatic cable head attached to a tool. FIG. 3C is a diagram of an automatic cable head after detaching from a tool using an explosive bolt. FIG. 3D is a diagram of an automatic cable head after detaching from a tool using a magnetic lock.

Load pin 343 is an optional structural member of automatic cable head 342. In one or more embodiments, load pin 343 is a load bearing member that traverses through automatic cable head 342 and supports release mechanism 360. In one or more embodiments, load pin 343 may provide an axis around which one or more components of release mechanism 360 (e.g., individual arms of claw 364) may pivot. That is, as a non-limiting example, when lock 362 allows for the movement of claw 364, claw 364 may open and close by pivoting one or more arm(s) around load pin 343.

Strain gauge 352 is an electromechanical device that measures the strain on an object. In one or more embodiments, strain gauge 352 may be affixed to an object such when the object deforms, strain gauge 352 may stretch or compress accordingly, leading to a change in the electrical resistance of strain gauge 352. In turn, the change in electrical resistance may be measured and correlated to the amount of strain experienced by the object. In one or more embodiments, strain gauge 352 may be used in various configurations to enhance sensitivity and accuracy, such as in a Wheatstone bridge, quartz crystal, vibrating wire, piezoelectric device, and/or any other suitable mechanism for measuring strain on an object. In one or more embodiments, strain gauge 352 may provide electrical resistance that may be measured by an external device (e.g., controller 356) and/or strain gauge 352 may internally correlate electrical resistance with load (in desired units) for output to an external device (e.g., controller 356).

Power supply 354 is an electrical component that provides electrical energy to various devices. In one or more embodiments, power supply 354 may store energy internally (i.e., a battery) and release it as electricity, enabling the operation of connected electrical devices (e.g., strain gauge 352, controller 356, lock 362, etc.). In one or more embodiments, power supply 354 may be external to automatic cable head 342 (e.g., uphole at the surface and transmitting power downhole). Non-limiting examples of power supply 354 include lithium-ion batteries, nickel-cadmium batteries, lead-acid batteries, capacitors, power from the surface transported downhole via wireline, and/or any other suitable means for releasing electrical energy.

Controller 356 is a computing device. In one or more embodiments, a computing device includes one or more processor(s), memory, persistent storage, and interfaces (e.g., wired and/or wireless network interfaces) for interfacing with strain gauge 352, power supply 354, lock 362, and/or any other suitable device. The persistent storage (and/or memory) may store computer instructions (e.g., computer code) which, when executed by the processor(s) of the computing device, cause the computing device to issue one or more requests and to receive one or more responses. Non-limiting examples of a computing device include a single-board computer, a programmable logic controller (PLC), an application specific integrated circuit (ASIC), field programmable gate array (FPGA), or any integrated circuit (IC). In one or more embodiments, controller 356 may be a partially (or entirely) analog device (i.e., lacking one (or all) "digital" components). As a non-limiting example, controller 356 may be a "comparator" circuit that includes only basic components of electrical circuitry (e.g., resistors, capacitors, inductors, diodes, operational amplifiers). In one or more embodiments, controller 356 may be located on the surface (e.g., as part of, or in addition to, information handling system 130) and may receive data from downhole (e.g., from strain gauge 352), process that data at the surface, and transmit data (e.g., a command) downhole to automatic cable 342 head and/or tool 144.

Threaded connection 358 is a mechanical fastener that may be formed on the outer body of automatic cable head 342. In one or more embodiments, threaded connection 358 is used to aid in the assembly of cable 140 to tool 144 using automatic cable head 342. That is, the lower portion of automatic cable head 342 may be tightly affixed to tool 144 (e.g., using seal(s) 366), allowing for release mechanism 360 to be affixed to fish neck 246, before the upper portion of automatic cable head 342 is threaded onto the lower portion of automatic cable head 342.

Release mechanism 360 is a mechanical device that releasably affixes to tool 144 (e.g., via fish neck 246). In one or more embodiments, release mechanism 360 includes lock 362 and claw 364. In one or more embodiments, release mechanism 360 is load bearing (i.e., experiencing the inline tension on cable 140) where release mechanism 360 may be supported by load pin 343. In one or more embodiments, release mechanism 360 may be controlled by controller 356.

Lock 362 is an electromechanical device that may constrain the movement of claw 364. In one or more embodiments, lock 362 may be controlled by controller 356 to actuate locking or unlocking claw 364 (i.e., constricting or allowing movement of claw 364, respectively). Non-limiting examples of lock 362 include an explosive bolt 362B (see FIG. 3C) and magnetic lock 362M (see FIG. 3D).

Explosion 363E (see FIG. 3C) is the result of the actuation of explosive bolt 362B. In one or more embodiments, controller 356 may cause the ignition of explosive bolt 362B leading to explosion 363E. In one or more embodiments, explosion 363E unlocks claw 364, allowing claw 364 to articulate more freely, and thereby allowing for the release of tool 144.

Unlock 363U (see FIG. 3D) is the result of the actuation of magnetic lock 362M. In one or more embodiments, controller 356 may cause the actuation of magnetic lock 362M leading to unlock 363U. In one or more embodiments, unlock 363U unlocks claw 364, allowing claw 364 to articulate more freely, and thereby allowing for the release of tool 144. In one or more embodiments, controller 356 may re-lock magnetic lock 362M, thereby allowing for the reuse of magnetic lock 362M on tool 144.

Claw 364 is a mechanical device that releasably attaches to fish neck 246. In one or more embodiments, claw 364 is shaped with a geometry to complement frustum 250 and narrow section 248. Claw 364 may be constructed from one or more pivoting arm(s) (e.g., pivoting around load pin 343) that allow for the attachment and detachment of tool 144 from automatic cable head 342.

Seal 366 is a mechanical device that provides a barrier to block (or reduce) the flow of fluid (gases or liquids) from freely traversing between two volumes. In one or more embodiments, seal 366 may operate by filling a gap (e.g., a cavity, a space) between the two volumes (e.g., by better adjoining objects that separate the two volumes). Seal 366 may be used to prevent (or limit) the flow of fluids between tool 144 and automatic cable head 342 (e.g., preventing fluid 128 from entering the internal volume of automatic cable head 342). Non-limiting examples of seal 366 include an O-ring, a gasket, a flexible membrane, or any other object of suitable material and shape.

FIG. 4

Figure 4:
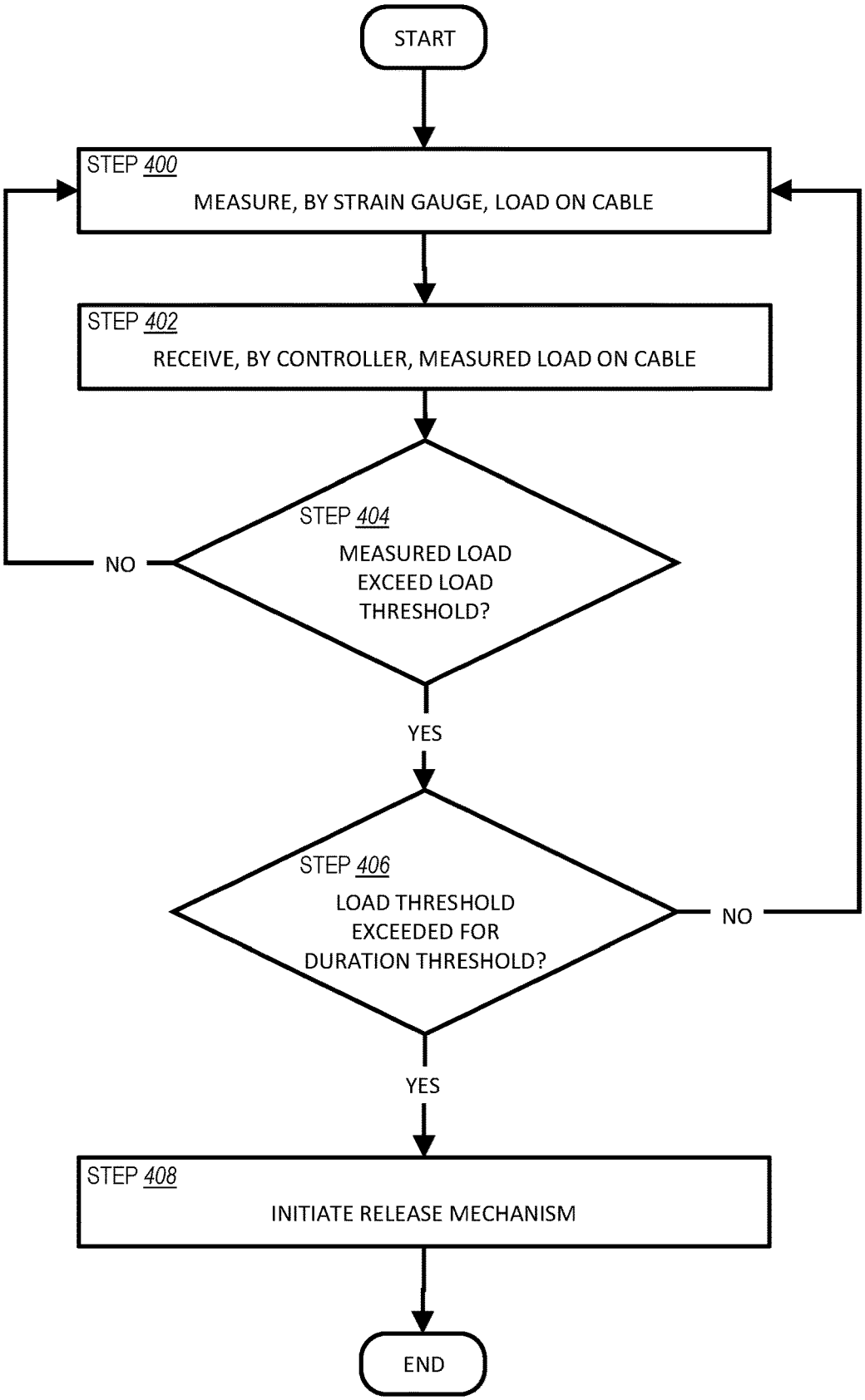
FIG. 4 is a flowchart of a method for controlling the release mechanism of an automatic cable head.

FIG. 4 is a flowchart of a method for controlling the release mechanism of an automatic cable head. All or a portion of the method shown may be performed by one or more components of controller 356 (or another component of automatic cable head 342). While the various steps in this flowchart are presented and described sequentially, a person of ordinary skill in the relevant art (having the benefit of this detailed description) would appreciate that some or all steps may be executed in different orders, combined, or omitted, and some or all steps may be executed in parallel.

In step 400, load on cable 140 is measured by strain gauge 352 (as "load measurement", "cable load measurement", "load data", "cable load data", "measured load", or "measured load data"). In one or more embodiments, strain gauge 352 may take continuous readings/measurements of the load on cable 140 (i.e., as the resistance of strain gauge 352 changes accordingly). In one or more embodiments, step 400 continues throughout and during steps 402-508.

In step 402, controller 356 receives the load data from strain gauge 352. In one or more embodiments, controller 356 may initiate receipt and recording of load data from strain gauge 352 and/or controller 356 may receive load data from strain gauge 352 without initiation by controller 356. Controller 356 may receive load data by measuring the electrical resistance across strain gauge 352 and correlating the electrical resistance to load via calibration. In one or more embodiments, controller 356 may receive load data, pre-calibrated and converted, from strain gauge 352. In one or more embodiments, upon receipt of load data, controller 356 may write load data into a database (e.g., a table, delimited text file, or any organized data structure, etc.) and may further add a timestamp to the database associated with the load data.

In step 404, controller 356 makes a determination as to whether the load data exceeds a preset load threshold. In one or more embodiments, the load threshold may be preset (e.g., prior to lowering tool 144 into borehole 116) to a desired load correlated to the working load and/or maximum tensile load of cable 140. As an example, the load threshold may be set to 90% of the working load (e.g., if the cable has a working load of 1,000 lbs, the load threshold will be 900 lbs). As another example, the load threshold may be set to 75% of the maximum tensile load (e.g., if the cable has a maximum tensile load of 1,500 lbs, the load threshold will be 1,125 lbs).

Upon comparing the load data to the load threshold, if controller 356 determines that the load data meets or exceeds the load threshold, the process continues to step 406 (step 404—YES). However, if controller 356 determines that load data does not meet or exceed the load threshold, the process returns to step 400 (step 404—NO).

In step 406, controller 356 makes a determination as to whether the duration of the load exceeds a duration threshold. That is, in one or more embodiments, the load on cable must both (i) exceed the load threshold (step 404), and (ii) exceed the load threshold for a consecutive period of time (step 406). Non-limiting examples of duration thresholds include 0.2 seconds, 0.5 seconds, 1.0 second, 1.1 seconds, 3.6 seconds, etc. In one or more embodiments, step 406 is optional, and step 404 may proceed directly step 408.

In one or more embodiments, to make this determination, controller 356 receives and stores two or more load data measurements from strain gauge 352 and stores them in a database. In turn, upon receipt of second (or subsequent) load data, controller 356 may look up the previous entry in the database and identify if the previous load data also exceeded the load threshold. If the load threshold was not exceeded in the previous entry, this step may end (step 406—NO), and the process returns to step 400. However, if the load threshold was exceeded, the difference between the most recent timestamp and the timestamp of the previous entry is calculated. If that difference in time exceeds the duration threshold, controller 356 determines that the duration threshold has been exceeded (step 406—YES) and the process continues to step 408. If, however, the duration threshold was not exceeded, controller 356 performs a look up of an earlier entry.

Upon reading the earlier (previously recorded) entry, controller 356 determines whether the load threshold (of the previous entry) was exceeded and if the duration threshold is exceeded. If the load threshold was not exceeded for the previous entry, this step may end (step 406—NO), and the process returns to step 400. Similarly, if the duration threshold is not exceeded (when comparing timestamps), this step may end (step 406—NO), and the process returns to step 400. However, if the load threshold (of the previous entry) is exceeded and the duration threshold is exceeded (step 406—YES), the process continues to step 408. One of ordinary skill in the art, provided the benefit of this detailed description, would understand that this process may continue until a determination is made either way.

To avoid running out of memory and/or storage on controller 356, controller 356 may overwrite existing entries and thereby provide a "moving window" of load data (e.g., in a circular buffer). For example, if the duration threshold is 1.7 seconds, controller may overwrite load data older than 2.0 seconds, providing enough storage to make a determination as to whether the duration threshold is surpassed and without storing unneeded load data.

In one or more embodiments, controller 356 may open a gate upon receiving load data that exceeds the load threshold (step 404—YES) and close the gate upon receiving load data that does not exceed the load threshold (step 404—NO). In such a scenario, the gate may be operatively connected to a clock (e.g., a timer) that determines the duration of time the gate has been opened. If the gate closes (i.e., due to receipt of load data below the load threshold), the clock is reset and controller 356 determines that the duration threshold has not been exceeded (step 406—NO) and the process returns to step 400. If the gate is open for a duration that meets (or exceeds) the duration threshold, controller 356 determines that the duration threshold has been exceeded (step 406—YES) and the process continues to step 408.

In step 408, controller 356 initiates release mechanism 360. In one or more embodiments, initiating release mechanism 360 includes actuating, igniting, and/or otherwise unlocking lock 362. Controller 356 may actuate lock 362 by sending a signal to lock 362 based on one or more known protocols or commands used to toggle lock 362 into releasing claw 364.

FIG. 5

Figure 5:
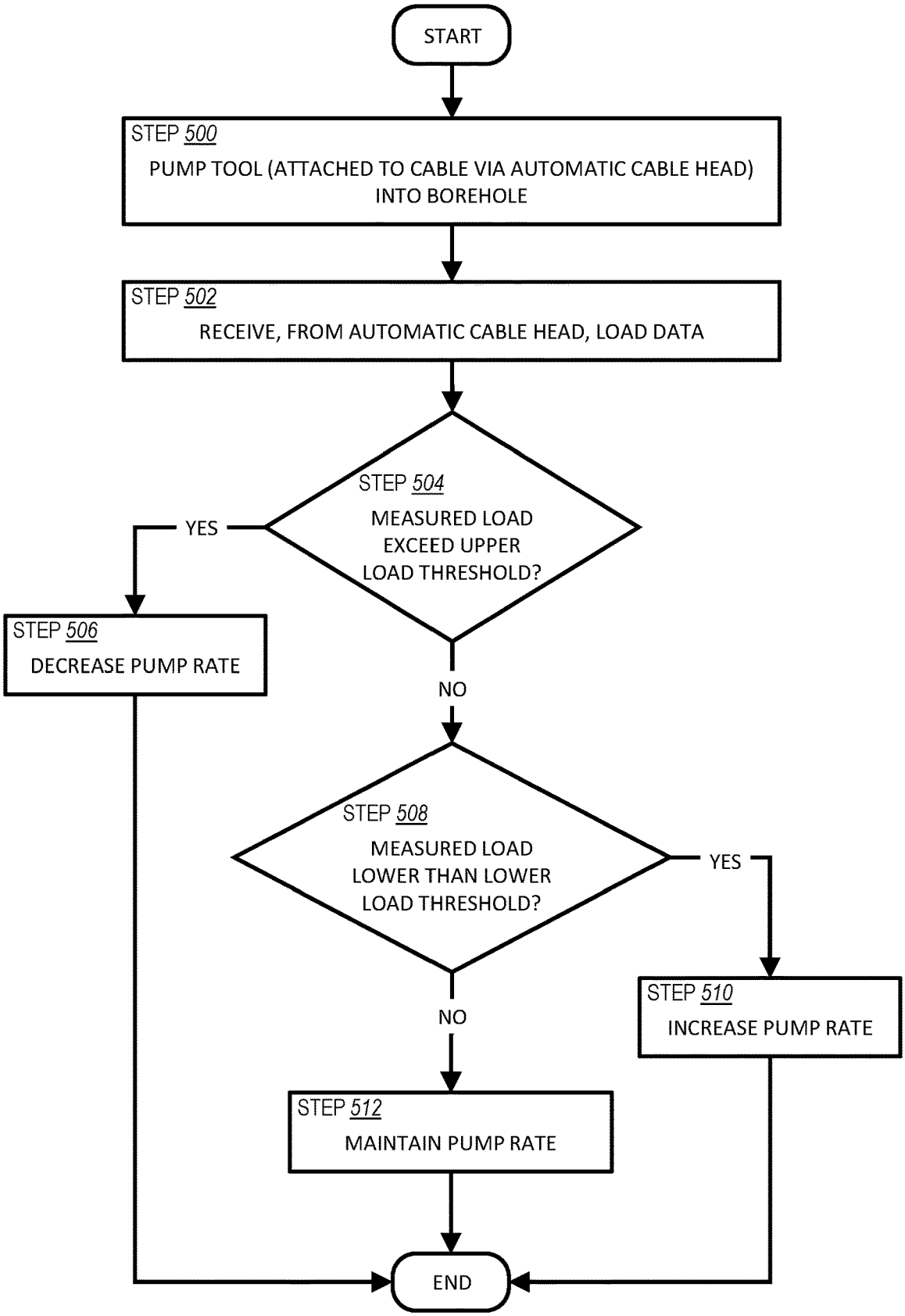
FIG. 5 is a flowchart of a method for placing a tool via a pump down operation.

FIG. 5 is a flowchart of a method for placing a tool via a pump down operation. All or a portion of the method shown may be performed by one or more components of information handling system 130 (and/or a user thereof). While the various steps in this flowchart are presented and described sequentially, a person of ordinary skill in the relevant art (having the benefit of this detailed description) would appreciate that some or all steps may be executed in different orders, combined, or omitted, and some or all steps may be executed in parallel.

In step 500, tool 144 (coupled to cable 140 via automatic cable head 342) is initially lowered into borehole. Pump 126 is then activated to cause fluid 128 to "push" tool 144 down borehole 116. In one or more embodiments, step 500 continues throughout and during steps 502-512.

In step 502, information handling system 130 receives load data from the automatic cable head 342 at the surface. In one or more embodiments, information handling system 130 may initiate receipt and recording of load data from automatic cable head 342. In one or more embodiments, information handling system 130 may receive raw resistance data (needing conversion to load values via calibration). In one or more embodiments, information handling system 130 may receive load data, pre-calibrated and converted, from controller 356 (or strain gauge 352). In one or more embodiments, upon receipt of load data, information handling system 130 may write load data into a database (e.g., a table, delimited text file, or any organized data structure, etc.) and associate the load data with a timestamp written into the database.

In step 504, information handling system 130 makes a determination as to whether the measured load data exceeds an upper load threshold. In one or more embodiments, an upper load threshold may be set to aid control of pump 126 when pumping down tool 144. Accordingly, if upper load threshold is exceeded, automatic cable head 342 may be at risk of detaching from tool 144. Accordingly, to avoid unwanted release of tool 144, load on cable 140 may be reduced by lowering the flow rate of pump 126. Thus, if the measured load data exceeds an upper load threshold (step 504—YES), the process continues to step 506. However, if measured load data does not exceed the upper load threshold (step 504—NO), the process continues to step 508.

In one or more embodiments, the upper load threshold may be set to some percentage of the load threshold (used internally in automatic cable head 342). As a non-limiting example, the upper load threshold may be set to 95% of the load threshold. Thus, if the load threshold is 900 lbs, the upper load threshold would be 855 lbs. In one or more embodiments, the upper load threshold may be based on the working load and/or maximum tensile load of cable 140.

In step 506, information handling system 130 (and/or a user thereof) controls pump 126 to lower the flow rate of fluid 128. In one or more embodiments, information handling system 130 may control pump 126 via a pump controller or other electronic device. By reducing the flow rate pushing tool 144 downhole, the load on cable 140 may be reduced, thereby decreasing the risk of automatic cable head 342 automatically detaching.

In step 508, information handling system 130 makes a determination as to whether the measured load data is lower than a lower load threshold. In one or more embodiments, a lower load threshold may be set to aid control of pump 126 when pumping down tool 144. Accordingly, if lower load threshold is not exceeded, the pump down operation may be sped up safely, without significant risk of detaching automatic cable head 342. Accordingly, to hasten the pump down of tool 144, load on cable 140 may be increased by increasing the flow rate of pump 126. Thus, if measured load data is lower than a lower load threshold (step 508—YES), the process continues to step 510. However, if measured load data exceeds the lower load threshold (step 508—NO), the process continues to step 512.

In one or more embodiments, the lower load threshold may be set to some percentage of the load threshold (used internally in automatic cable head 342). As a non-limiting example, the lower load threshold may be set to 70% of the load threshold. Thus, if the load threshold is 900 lbs, the lower load threshold would be 630 lbs. In one or more embodiments, the lower load threshold may be based on the working load and/or maximum tensile load of cable 140.

In step 510, information handling system 130 (and/or a user thereof) controls pump 126 to increase the flow rate of fluid 128. In one or more embodiments, information handling system 130 may control pump 126 via a pump controller or other electronic device. By increasing the flow rate pushing tool 144 downhole, the load on cable 140 may increase thereby increasing the risk of automatic cable head 342 detaching automatically (however, that risk is managed via steps 504 and 506).

In step 512, information handling system 130 (and/or a user thereof) does not change the flow rate of fluid 128 from pump 126. In one or more embodiments, if information handling system 130 determines that the measured load does not exceed the upper load threshold (step 504—NO) and the flow rate is not lower than the lower load threshold (step 508—NO), then pump 126 may continue to operate at the current flow rate (balancing the speed of the pump down operation with the risk of detaching the automatic cable head).

Statements

The systems and methods may comprise any of the various features disclosed herein, comprising one or more of the following statements.

Statement 1. A system, comprising an automatic cable head, comprising a strain gauge configured to measure a tension associated with a cable attached to the automatic cable head; a release mechanism configured to connect to a tool; a controller, configured to receive load data from the strain gauge; control the release mechanism based on the tension measured by the strain gauge.

Statement 2. The system of statement 1, wherein the release mechanism comprises a lock; a claw.

Statement 3. The system of statement 2, wherein controlling the release mechanism comprises making a first determination that the load data is greater than a load threshold; initiating release of the lock in response to the first determination.

Statement 4. The system of statement 3, wherein initiating release of the lock causes the claw to open.

Statement 5. The system of statements 2-4, wherein the lock is an explosive bolt.

Statement 6. The system of statements 2-5, wherein the lock is a magnetic lock.

Statement 7. The system of statements 2-6, wherein the claw is configured to connect to a fish neck of the tool.

Statement 8. The system of statement 7, wherein the fish neck comprises a narrow section and a frustum.

Statement 9. The system of statements 1-8, wherein the automatic cable head further comprises the controller.

Statement 10. A method for releasing a tool, comprising receiving, by a controller, first load data from a strain gauge in an automatic cable head making a first determination that the first load data is greater than a load threshold; initiating release of a lock in response to the first determination.

Statement 11. The method of statement 10, wherein prior to initiating release of the lock, the method further comprises receiving second load data from the strain gauge; making a second determination that the second load data is greater than the load threshold wherein initiating release of the lock is further in response to the second determination.

Statement 12. The method of statement 11, wherein prior to initiating release of the lock, the method further comprises making a third determination that a duration between the first load data and the second load data is greater than a duration threshold wherein initiating release of the lock is further in response to the third determination.

Statement 13. The method of statement 12, wherein initiating release of the lock causes the tool to separate from the automatic cable head.

Statement 14. The method of statements 10-13, wherein the lock is one selected from the group consisting of an explosive bolt; a magnetic lock.

Statement 15. The method of statements 10-14, wherein the load threshold is less than a working load for a cable, wherein the automatic cable head is attached to the cable.

Statement 16. The method of statements 10-15, wherein the load threshold is greater than a working load for a cable, wherein the automatic cable head is attached to the cable.

Statement 17. A method for pumping a tool into a borehole, comprising pumping the tool into the borehole using a pump configured to pump a fluid at a flow rate, wherein the tool is attached to a cable via an automatic cable head receiving first load data from the automatic cable head making a first determination that the first load data exceeds an upper load threshold; controlling the pump to reduce the flow rate based on the first determination.

Statement 18. The method of statement 17, wherein the method further comprises receiving second load data from the automatic cable head; making a second determination that the second load data does not exceed the upper load threshold.

Statement 19. The method of statement 18, wherein the method further comprises receiving third load data from the automatic cable head making a third determination that the third load data is below a lower load threshold; controlling the pump to increase the flow rate based on the third determination.

Statement 20. The method of statement 19, wherein the method further comprises increasing a tension on the cable while pumping the tool downhole causing the tension to increase beyond a load threshold; causing the automatic cable head to separate from the tool.

General Notes

As it is impracticable to disclose every conceivable embodiment of the technology described herein, the figures, examples, and description provided herein disclose only a limited number of potential embodiments. A person of ordinary skill in the relevant art would appreciate that any number of potential variations or modifications may be made to the explicitly disclosed embodiments, and that such alternative embodiments remain within the scope of the broader technology. Accordingly, the scope should be limited only by the attached claims. Further, the compositions and methods are described in terms of "comprising," "containing," or "including" various components or steps, the compositions and methods may also "consist essentially of" or "consist of" the various components and steps. Moreover, the indefinite articles "a" or "an," as used in the claims, are defined herein to mean one or more than one of the elements that it introduces. Certain technical details, known to those of ordinary skill in the relevant art, may be omitted for brevity and to avoid cluttering the description of the novel aspects.

For further brevity, descriptions of similarly named components may be omitted if a description of that similarly named component exists elsewhere in the application. Accordingly, any component described with respect to a specific figure may be equivalent to one or more similarly named components shown or described in any other figure, and each component incorporates the description of every similarly named component provided in the application (unless explicitly noted otherwise). A description of any component is to be interpreted as an optional embodiment—which may be implemented in addition to, in conjunction with, or in place of an embodiment of a similarly-named component described for any other figure.

Lexicographical Notes

As used herein, adjective ordinal numbers (e.g., first, second, third, etc.) are used to distinguish between elements and do not create any ordering of the elements. As an example, a "first element" is distinct from a "second element", but the "first element" may come after (or before) the "second element" in an ordering of elements. Accordingly, an order of elements exists only if ordered terminology is expressly provided (e.g., "before", "between", "after", etc.) or a type of "order" is expressly provided (e.g., "chronological", "alphabetical", "by size", etc.). Further, use of ordinal numbers does not preclude the existence of other elements. As an example, a "table with a first leg and a second leg" is any table with two or more legs (e.g., two legs, five legs, thirteen legs, etc.). A maximum quantity of elements exists only if express language is used to limit the upper bound (e.g., "two or fewer", "exactly five", "nine to twenty", etc.). Similarly, singular use of an ordinal number does not imply the existence of another element. As an example, a "first threshold" may be the only threshold and therefore does not necessitate the existence of a "second threshold".

As used herein, the word "data" may be used as an "uncountable" singular noun—not as the plural form of the singular noun "datum". Accordingly, throughout the application, "data" is generally paired with a singular verb (e.g., "the data is modified"). However, "data" is not redefined to mean a single bit of digital information. Rather, as used herein, "data" means any one or more bit(s) of digital information that are grouped together (physically or logically). Further, "data" may be used as a plural noun if context provides the existence of multiple "data" (e.g., "the two data are combined").

As used herein, the term "operative connection" (or "operatively connected") means the direct or indirect connection between devices that allows for the transmission of data. For example, the phrase 'operatively connected' may refer to a direct connection (e.g., a direct wired or wireless connection between devices) or an indirect connection (e.g., multiple wired and/or wireless connections between any number of other devices connecting the operatively connected devices).

As used herein, indefinite articles "a" and "an" mean "one or more". That is, the explicit recitation of "an" element does not preclude the existence of a second element, a third element, etc. Further, definite articles (e.g., "the", "said") mean "any one of" (the "one or more" elements) when referring to previously introduced element(s). As an example, there may exist "a processor", where such a recitation does not preclude the existence of any number of other processors. Further, "the processor receives data, and the processor processes data" means "any one of the one or more processors receives data" and "any one of the one or more processors processes data". It is not required that the same processor both (i) receive data and (ii) process data. Rather, each of the steps ("receive" and "process") may be performed by different processors.

As used herein, "machine" means any collection of components assembled to form a tool, structure, or other apparatus. A collection of components may be grouped together and referred to as a single 'machine' based on the functionality of the machine enabled by the combination of the components. As a non-limiting example, a "car engine" is a machine assembled from the components of an engine block, one or more piston(s), a camshaft, etc. that, when combined, function to convert chemical energy into mechanical energy. Further, a machine may be constructed using one or more other machine(s). As a non-limiting example, an automobile may be an assembly of a car engine, a drivetrain, and a steering system—each an independent machine—but assembled to form a larger machine, singularly referred to as an "automobile" which functions to provide transportation.

As used herein, "real-time" may be generally understood to relate to a system, apparatus, or method in which a set of input data is available for use within 100 milliseconds ("ms"). Additionally, as used herein, "real-time" may refer to any duration of time to acquire and/or otherwise process data that is sufficiently short enough for a human to believe the data is providing an up-to-date and/or accurate representation of the underlying system. Accordingly, "real-time" may be context specific. As a first non-limiting example, 20 ms (or less) may be the maximum allowable latency to avoid inducing nausea in a human using a virtual reality headset (i.e., providing "real-time" sensory stimulation for motion detected by the inner ear and motion detected by eyesight). As a second non-limiting example, motor vibration data that is displayed on a monitor one second after the vibration occurred may be considered "real-time". And, as a third non-limiting example, measured movements of Earth's tectonic plates—obtained and processed only once per day—may be considered "real-time".

What is claimed is:

1. A system, comprising:

an automatic cable head disposed in a borehole, comprising:

a strain gauge configured to measure a tension associated with a cable attached to the automatic cable head;

a release mechanism configured to connect to a tool; and a controller, configured to:

receive load data from the strain gauge; and make a determination that the load data has been greater than a load threshold for a duration exceeding a duration threshold; and initiate release of the release mechanism in response to the determination.

2. The system of claim 1, wherein the release mechanism comprises:

a lock; and a claw, wherein initiating release of the release mechanism comprises:

initiating release of the lock.

3. The system of claim 2, wherein initiating release of the lock causes the claw to open.

4. The system of claim 2, wherein the lock is an explosive bolt.

5. The system of claim 2, wherein the lock is a magnetic lock.

6. The system of claim 2, wherein the claw is configured to connect to a fish neck of the tool.

7. The system of claim 6, wherein the fish neck comprises a narrow section and a frustum.

8. The system of claim 1, further comprising:

a power supply.

9. A method for releasing a tool, comprising:

receiving, by a controller in an automatic cable head, first load data from a strain gauge in the automatic cable head;

making a first determination that the first load data is greater than a load threshold;

receiving second load data from the strain gauge;

making a second determination that the second load data is greater than the load threshold;

making a third determination that a duration between the first load data and the second load data is greater than a duration threshold; and initiating release of a lock in response to the third determination.

10. The method of claim 9, wherein initiating release of the lock causes the tool to separate from the automatic cable head.

11. The method of claim 9, wherein the lock is one selected from the group consisting of:

an explosive bolt; and a magnetic lock.

12. The method of claim 9, wherein the load threshold is less than a working load for a cable, and wherein the automatic cable head is attached to the cable.

13. The method of claim 9, wherein the load threshold is greater than a working load for a cable, and wherein the automatic cable head is attached to the cable.

14. The method of claim 9, wherein the automatic cable head comprises:

a power supply.

15. A method for pumping a tool into a borehole, comprising:

pumping the tool into the borehole using a pump configured to pump a fluid at a flow rate, wherein the tool is attached to a cable via an automatic cable head;

receiving first load data from the automatic cable head;

making a first determination that the first load data exceeds an upper load threshold;

controlling the pump to reduce the flow rate based on the first determination;

receiving second load data from the automatic cable head;

making a second determination that the second load data is below a lower load threshold; and controlling the pump to increase the flow rate based on the second determination.

16. The method of claim 15, wherein the method further comprises:

receiving third load data from the automatic cable head; and making a third determination that the third load data does not exceed the upper load threshold.

17. The method of claim 16, wherein the method further comprises:

increasing a tension on the cable while pumping the tool downhole;

causing the tension to increase beyond a load threshold; and causing the automatic cable head to separate from the tool.

18. The method of claim 16, wherein the method further comprises:

making a fourth determination that the third load data is not below the lower load threshold.

19. The method of claim 18, wherein the method further comprises:

maintain the flow rate based on the third determination and the fourth determination.

20. The method of claim 15, wherein the automatic cable head comprises:

a controller; and a power supply.

* * * * *